United States Patent [19]

Leibscher et al.

[11] 4,263,689

[45] Apr. 28, 1981

[54] CARPET SWEEPING DEVICE

[75] Inventors: Johannes Leibscher, Nassau; Rolf G. Schülein, Singhofen, both of Fed. Rep. of Germany

[73] Assignee: Leifheit International Günter Leifheit GmbH, Nassau, Fed. Rep. of Germany

[21] Appl. No.: 926,848

[22] Filed: Jul. 21, 1978

Related U.S. Application Data

[63] Continuation of Ser. No. 758,548, Dec. 30, 1976, Pat. No. 4,207,641.

[30] Foreign Application Priority Data

Jan. 2, 1976 [DE] Fed. Rep. of Germany ..... 2600102
Feb. 13, 1978 [DE] Fed. Rep. of Germany ..... 2605835

[51] Int. Cl.[3] ..... A47L 11/33
[52] U.S. Cl. ..... 15/41 R
[58] Field of Search ..... 15/41 R–48, 15/79 R, 79 A, 83

[56] References Cited

U.S. PATENT DOCUMENTS

| | | | |
|---|---|---|---|
| 1,098,507 | 6/1914 | Krantz | 15/41 B |
| 2,101,133 | 12/1937 | Dilliard | 15/41 R |
| 2,235,432 | 3/1941 | Kenyon | 15/41 R |
| 2,240,683 | 5/1941 | Berger | 15/41 R |

FOREIGN PATENT DOCUMENTS

| | | | |
|---|---|---|---|
| 147101 | 8/1931 | Switzerland | 15/79 R |
| 20666 | of 1912 | United Kingdom | 15/41 R |
| 474772 | 11/1937 | United Kingdom | 15/41 R |
| 1442587 | 7/1976 | United Kingdom | 15/41 R |

*Primary Examiner*—Edward L. Roberts
*Attorney, Agent, or Firm*—Michael J. Striker

[57] ABSTRACT

A cylindrical brush is mounted in a housing of a carpet-sweeping device or the like for rotation about an axis extending transversely of the direction of movement of the device over the surface to be cleaned. Two dirt-collecting receptacles are located respectively at the front region of the housing and at the rear region of the housing as considered in the direction of movement of the receptacle over the surface being swept. The dirt-collecting receptacles are removably mounted on the housing, and arrested in their respective fully inserted positions. The dirt-collecting receptacle can be introduced into the housing from the side through one of the lateral portions, from the front, from the rear, from below and from above, depending on the particular construction of the housing. Various arrangements for arresting the dirt-collecting receptacle in its fully inserted position are disclosed. The dirt-collecting receptacle proper has an inlet opening bounded by the top and bottom walls, as well as the two lateral walls, of the dirt-collecting receptacle. A guide wall may be provided which extends upwardly from the bottom wall at an angle thereto away from the brush, and a closing wall may be hinged to the top wall of the dirt-collecting receptacle and be held in its open position when the dirt-collecting receptacle assumes its fully inserted position, while assuming its closed position during the removal of the dirt-collecting receptacle from the housing.

7 Claims, 14 Drawing Figures

FIG. 12
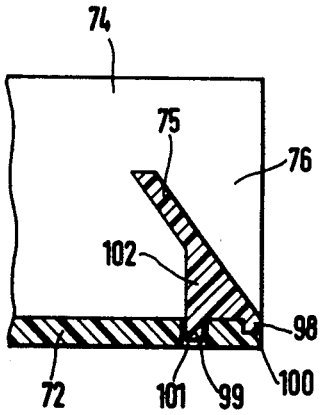
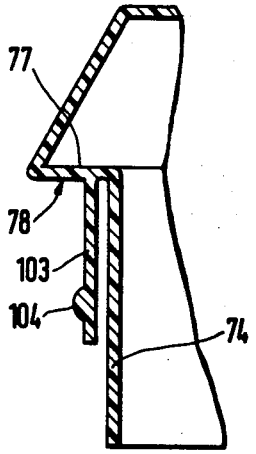
FIG. 13
FIG. 14
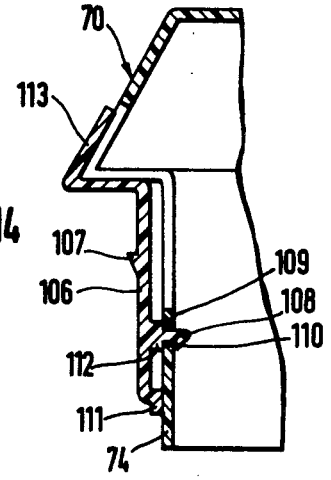

CARPET SWEEPING DEVICE

This is a continuation of application Ser. No. 758,548, filed Dec. 30, 1976, now U.S. Pat. No. 4,207,641.

BACKGROUND OF THE INVENTION

The present invention relates to a device for sweeping surfaces, particularly carpets and the like.

Carpet-sweeping and similar devices are already known and usually they include a housing in which there is mounted for rotation at least one cylindrical brush which contacts the surface being swept, picks up dirt from such surface as it is being rotated about the axis, and transports the picked-up dirt in a path for deposition in a dirt-collecting receptacle or a plurality of such receptacles.

In the conventional devices of this type, it has been proposed to define the dirt-collecting receptacles by portions of the housing. Inasmuch as the collected dirt must be periodically discharged from the dirt-collecting receptacle or receptacles, it has also already been proposed to displaceably mount one of the portions of the housing which defines the dirt-collecting receptacle on the remainder of the housing, so as to be able to discharge the accumulated dirt through a discharge opening which, in the normal working condition, is closed by such displaceable portion. However, experience has shown that these conventional arrangements are disadvantageous in that, when it is desired to discharge the accumulated dirt from the dirt-collecting receptacle or receptacles, it is necessary to transport the entire sweeping device to a waste receptacle or the like, upon which the dirt-collecting receptacle is emptied of the dirt which has previously accumulated therein. However, inasmuch as the sweeping device is usually provided with an elongated actuating handle, this dirt-discharging operation is rather cumbersome and difficult to accomplish.

SUMMARY OF THE INVENTION

It is a general object of the present invention to avoid the above-mentioned disadvantage.

More particularly, it is an object of the present invention to provide a sweeping device of the type here under consideration which is not possessed of the disadvantages of the prior art sweeping devices.

It is still another object of the present invention to provide a carpet-sweeping device which is simple in construction, convenient to operate, and reliable nevertheless.

It is a concomitant object of the present invention to so construct the sweeping device that the dirt-collecting receptacle or receptacles thereof can be emptied of the dirt accumulated therein in an easy and simple manner.

In pursuance of these objects and others which will become apparent hereafter, one feature of the present invention resides, briefly stated, in a device for sweeping surfaces, particularly carpets and the like, which comprises a housing; at least one brush mounted on said housing in contact with the surface to be swept for rotation about an axis; means for rotating said brush about said axis so that dirt is picked up by said brush from a surface being swept and travels in at least one path; at least one dirt-collecting receptacle; and means for removably mounting said dirt-collecting receptacle on said housing so as to be located about and in said path for deposition of dirt therein when mounted on said housing, and to be removable from said housing for discharging deposited dirt therefrom. Preferably, the housing has a bottom and a top which respectively face toward and away from the surface being swept, front and back regions as considered in the direction of movement of said housing over such surface, and a pair of lateral sides which extend between said front and back region and spaced from one another transversely of said direction. Then, said brush is cylindrical and said axis thereof extends between said lateral sides of said housing. A particular advantage of this removable mounting of the dirt-collecting receptacle on the housing is to be seen in the fact that it is now sufficient to remove the dirt-collecting receptacle from the housing and to transport only such removed dirt-collecting receptacle to the waste-accepting vessel, while the remainder of the sweeping device is left at the location of previous use or at a storage area.

The dirt-collecting receptacle which is removably mounted on the housing has a substantially rectangular bottom wall, a limiting wall spaced from said brush, and a pair of side walls arranged laterally of said brush and extending therefrom along said bottom wall toward said limiting wall, the latter and said side walls extending substantially normal to and upwardly from said bottom wall, being connected thereto and to one another, said bottom and said side walls bounding an inlet opening of said dirt-collecting receptacle situated in said path. Preferably, said dirt-collecting receptacle further has a guiding wall at said inlet opening and connected to and extending from said bottom wall at an angle to the latter away from said brush. When constructed in this manner, the dirt-collecting receptacle which is removably mounted on the housing has sufficient rigidity and can accommodate a substantial amount of dirt.

The dirt-collecting receptacle which is removably mounted on the housing may also include a top wall connected to and extending between said side wall and said limiting wall at a distance from said bottom wall, which top wall bounds the interior of the dirt-collecting receptacle in the upward direction. In this manner, the dirt-collecting receptacle which is removably mounted on the housing is closed also in the upward direction as considered in the position which the sweeping device assumes during its use, so that the collected dirt cannot fall out of the dirt-collecting receptacle even upon removal thereof from the housing. However, the dirt can still enter the dirt-collecting receptacle, during the operation of the sweeping device, through the above-mentioned inlet opening.

In a particular advantageous manner, the dirt-collecting receptacle which is removably mounted on the housing can be introduced into the housing through one of the lateral sides thereof and in parallelism with the axis of rotation of the cylindrical brush. Thus, the dirt-collecting receptacle is constructed in a manner resembling a drawer and can be introduced into and removed from the housing through said one lateral side thereof in a manner resembling the introduction and withdrawal of a drawer.

However, the dirt-collecting receptacle which is removably mounted on the housing can also be introduceable into the housing from below as considered in the operating position of the sweeping device. In this embodiment, the housing is downwardly open, so that the dirt-collecting receptacle can be introduced into the housing from below. The bottom wall of the dirt-collecting receptacle of this embodiment simultaneously constitutes part of the bottom of the sweeping device.

On the other hand, it is also possible and proposed by the present invention to introduce the dirt-collecting receptacle removably mounted on the housing into the latter from above as considered in the operating position of the sweeping device. In this embodiment, the top wall of the dirt-collecting receptacle which closes the latter from above can also constitute a portion of the top of the sweeping device.

According to a further concept of the present invention, the dirt-collecting receptacle which is removably mounted on the housing of the sweeping device can be introduced into the housing from the front region or from the rear region, in parallelism to the surface to be swept in the operating position of the sweeping device. In this embodiment, the housing constitutes substantially only the central region of the sweeping device and serves the purpose of holding and supporting the cylindrical brush and wheels or rollers by means of which the sweeping device is moved over the surface being swept. In this embodiment, two dirt-collecting receptacles can be introduced into the housing parallel to the surface to be swept in the operating position of the sweeping device, from the front and from the rear of the housing, respectively.

The housing is provided with apertures for receiving the dirt-collecting receptacle which is removably mounted on the housing, and guide means for guiding the dirt-collecting receptacle toward and away from a fully inserted position in the aperture. In this manner, the dirt-collecting receptacle is introducible into and removable from the aperture in an especially simple manner. In order to hold the dirt-collecting receptacle which is removably mounted on the housing, on the latter, there may be provided arresting means which holds the dirt-collecting receptacle in the aperture when fully inserted therein. In this manner, the dirt-collecting receptacle is reliably held in the housing but can be easily removed therefrom, particularly when the arresting means that arrests the dirt-collecting receptacle to the housing in the fully inserted position is of the type which engages with snap action.

In one currently preferred embodiment of the present invention, the dirt-collecting receptacle which is removably mounted on the housing has a horizontally extending groove in each of its side walls, and the arresting means includes a rib-shaped projection of the housing which is received in one of the grooves, and a projection provided on a tongue which, in turn, is mounted on the housing for deflection, such projection being received in the other groove. When the arresting means is constructed in this manner, it reliably holds the dirt-collecting receptacle in the housing when in its fully inserted position, while it is possible to easily remove the receptacle from the aperture in which it is accommodated by deflecting the tongue so that the projection thereof is retracted from the other groove of the dirt-collecting receptacle, thus freeing the latter for removal from the housing.

In order to be able to easily deflect the tongue, the latter is provided with an extension which serves as a handgrip portion which can be grasped by the user of the receiving device and moved away from the side wall of the dirt-collecting receptacle which is accommodated in the aperture, thereby deflecting the projection of the tongue out of the groove. It will be appreciated that the provision of this handgrip portion greatly facilitates the deflection of the deflectable tongue.

In the embodiment in which the dirt-collecting receptacle is insertable into the housing from above, the side walls of the dirt-collecting receptacle are formed with bulges which have abutment shoulders by means of which the dirt-collecting receptacle rests on a border region which surrounds the aperture of the housing. The provision of the abutment shoulders on the bulges result in reliable arresting of the dirt-collecting receptacle on the border region of the housing.

The dirt-collecting receptacle and/or the housing which may have a frame-shaped portion can be provided with projections having inclined surfaces which cooperate with edges of the housing or of the dirt-collecting receptacle, respectively. In this manner, an especially advantageous arresting of the dirt-collecting receptacle in the frame-shaped portion of the housing is achieved when the dirt-collecting receptacle is fully inserted into the aperture bounded by the frame-shaped portion of the housing, while the dirt-collecting receptacle can be easily removed from the housing by applying a force to the bottom wall thereof, whereby the arresting action of the projections is overcome and the dirt-collecting receptacle is pushed upwardly out of the aperture receiving the same.

The upper border region of the frame-shaped portion of the housing has an inwardly oriented rib-shaped projection of the resting of the abutment shoulders of the dirt-collecting receptacle thereon, the dirt-collecting receptacle having resiliently yieldable arresting members which engage behind the rib-shaped projection. As a result of this construction, the frame-shaped portion of the housing possesses a sufficiently wide resting surface for the resting of the abutment shoulder of the dirt-collecting receptacle thereon. In addition thereto, the rigidity of the frame-shaped portion of the housing is increased. Additionally, the inwardly oriented rib-shaped projection constitutes a part of the arresting means engaged by the resiliently yieldable arresting portions of the dirt-collecting receptacle.

As further proposed by the present invention, the resiliently yieldable arresting portion can be constituted by a tongue which is separated from the respective side wall of the dirt-collecting receptacle by a U-shaped slot, the tongue being flexibly connected to such side wall. The free end of the tongue extends upwardly of the frame-shaped portion of the housing in the fully inserted position of the dirt-collecting receptacle, while the other end of the tongue, which is located underneath the inwardly oriented rib-shaped projection of the frame-shaped portion of the housing at the region of merger of the tongue with the remainder of the respective side wall of the dirt-collecting receptable in the fully inserted position of the latter, is provided with an outwardly extending projection of an angular configuration which engages behind the inwardly oriented rib-shaped projection of the frame-shaped portion of the housing. The outwardly extending, angular, tongue-shaped projection snaps behind the inwardly oriented rib-shaped projection of the frame-shaped portion of the housing upon pressing the dirt-collecting receptacle into its fully inserted position, whereupon the dirt-collecting receptacle is reliably arrested in the aperture of the frame-shaped portion of the housing. When it is desired to release the dirt-collecting receptacle from the frame-shaped portion of the housing, the tongue which is separated from the remainder of the respective side wall by the U-shaped slit is pressed inwardly so that the tongue-shaped projection of the tongue is brought out of engagement with the inwardly oriented rib-shaped projection of the frame-shaped portion of the housing. After that, the dirt-collecting receptacle can be removed from the frame-shaped portion of the housing in the upward direction.

On the other hand, the resiliently yieldable flexible arresting portion can also be constituted by bulging shoulders of an upwarddly oriented tongue which is separated from the respective wall of the dirt-collecting receptacle by a U-shaped slit. These bulges then snap behind the inwardly oriented rib-shaped projection of the frame-shaped portion of the housing upon introduction of the dirt-collecting receptacle into the frame-shaped portion of the housing, so that the dirt-collecting receptacle is reliably held in the frame-shaped portion of the housing. When the dirt-collecting receptacle is to be released from the frame-shaped portion of the housing, the above-mentioned tongue which is separated from the respective wall by the U-shaped slit and which extends upwardly, is pressed inwardly so that the bulges are retracted from the engagement thereof with the inwardly oriented rib-shaped projection of the frame-shaped portion of the housing and the dirt-collecting receptacle can be removed from the latter.

In order to be able to remove the dirt-collecting receptacle of this type from the housing using only one hand, tongues can be respectively provided on both side walls of the dirt-collecting receptacle, these tongues having free ends which are connected with one another by a connecting portion. Thus, when the connecting portion is pulled upwardly, both of the tongues are resiliently deflected in the inward direction of the dirt-collecting receptacle so that the arresting portions disengage the rib-shaped inwardly oriented projection of the frame-shaped portion of the housing. This upward pulling of the connecting portion provided on the dirt collecting receptacle can be achieved by using only one hand, so that the other hand can be utilized for holding the housing of the sweeping device steady during the removal of the dirt-collecting receptacle therefrom.

It is also proposed, according to a further concept of the present invention, to provide one tongue on each side wall of the dirt-collecting receptacle, the upwardly extending free ends of the tongues extending all the way up to the top wall of the dirt-collecting receptacle, and the tongues having gripping projections at these free ends, such gripping projections being situated at such a distance from one another that both of them can be simultaneously gripped by one hand of the user of the sweeping device, and displaced relative to one another. In this manner, the two tongues can be conveniently and in a very simple manner, displaced into their positions in which they release the dirt-collecting receptacle from the frame-shaped portion of the housing, using only one hand.

Furthermoe, the resiliently yieldable arresting portion can also be constituted by an outwardly oriented pin, which is provided on each of the flexible tongues and which is received in a corresponding arresting recess of the frame-shaped portion of the housing. This outwardly oriented pin snaps, due to the biasing action of the resiliently yieldable tongue, in the corresponding arresting recess during the introduction of the dirt-collecting receptacle into the frame-shaped portion of the housing. In order to release the dirt-collecting receptacle for removal from the frame-shaped portion of the housing, the pin can be removed from its engagement in the recess by resilient deflection of the tongue.

The dirt-collecting receptacle may further have a closing wall arranged at the inlet opening of the dirt-collecting receptacle, which closing wall, when in its basic position assumed when the dirt-collecting receptacle is accommodated in the aperture of the housing and is in its fully inserted position, affords access into the interior of the dirt-collecting receptacle through the inlet opening. In this manner, the dirt picked up by the brush and advanced in the above-mentioned path during the operation of the sweeping device can enter and become deposited in the interior of the dirt-collecting receptacle, while it is possible to close the inlet opening of the dirt-collecting receptacle during or upon removal of the dirt-collecting receptacle from the housing, so that the dirt accumulated in the interior of the dirt-collecting receptacle cannot inadvertently be discharged from the interior of the receptacle.

The closing wall which is adapted to close the inlet opening of the dirt-collecting receptacle can automatically assume its closing position during the removal of the dirt-collecting receptacle from the aperture of the housing. In this manner, the handling of the sweeping device is facilitated, in that the closing wall arranged at the inlet opening of the dirt-collecting receptacle is already in its closed position when the dirt-collecting receptacle is removed from the housing.

According to a further concept of the present invention which is used in connection with a construction of the sweeping device in which the dirt-collecting receptacle is connected to the housing from the front or from the rear thereof, the closing wall is preferably constructed as a flap which is connected to the top wall of the dirt-collecting receptacle which closes the top of the latter for pivoting relative thereto, and the housing may have an abutting projection which engages the flap-shaped closing wall during the terminal phase of movement of the dirt-collecting receptacle relative to the housing during the insertion thereof into the above-mentioned aperture, so that the flap-shaped closing wall is resiliently deflected and uncovers the inlet opening of the dirt-collecting receptacle. In this manner, it is achieved in a very simple manner that the flap-shaped closing wall arranged at the inlet opening of the dirt-collecting receptacle and assuming its closing position when the dirt-collecting receptacle is disassembled from the housing, is brought into its open position and held therein during and upon introduction of the dirt-collecting receptacle into the housing.

The flap-shaped closing wall which is hingedly connected to the top wall of the dirt-collecting receptacle which closes the latter in the upward direction thereof, assumes the closing position thereof during and upon removal of the dirt-collecting receptacle from the housing, due to its own gravity. In this manner, the displacement of the flap-shaped closing wall into its closing position is achieved in an especially advantageous manner inasmuch as the weight of the closing wall is utilized for this purpose.

Preferably, a dirt-collecting receptacle is made of synthetic plastic material, and then the flap-shaped closing wall is formed of one piece with the remainder of the dirt-collecting receptacle and connected thereto by means of a weakened flexible hinging portion. In this manner, it is possible to advantageously manufacture the dirt-collecting receptacle in its entirety in one continuous manufacturing operation.

Under these circumstances, also the guiding wall which is arranged below the inlet opening of the dirt-collecting receptacle and extends from the bottom wall of the dirt-collecting receptacle at an angle with respect thereto away from the brush in the assembled condition of the dirt-collecting receptacle with the housing, is connected to the bottom wall by means of a flexible weakened portion, and is provided at its lateral edges with projections when engage in corresponding recesses of the side walls of the dirt-collecting receptacle.

In this manner, the guide walls can be produced during the production of the dirt-collecting receptacle of synthetic plastic material in an injection molding operation in the same plane as the bottom wall. After the production of the dirt-collecting receptacle in the injection molding operation, the guide wall is then erected and positioned in its final position at the required angle to the bottom wall, extending upwardly from the bottom wall. In this angular position of the guide wall, the projections provided on the lateral edges of the guide wall are received in the corresponding recesses of the side walls of the dirt-collecting receptacle, so that the upwardly bent guide wall is reliably held in the thus assumed position.

As an alternative, the guide wall is separate from the remainder of the dirt-collecting receptacle and, under these circumstances, this guide wall which encloses an angle with the bottom wall of the dirt-collecting receptacle and extends away from the brush in the assembled condition of the latter with the housing, has engaging portions which are received in recesses provided in the bottom wall of the dirt-collecting receptacle, in a positive manner, and has projections on the lateral edges thereof which are received in the corresponding recesses of the side walls of the dirt-collecting receptacle. In this manner, the dirt-collecting receptacle can be produced in a particularly simple manner in an injection molding operation of synthetic plastic material, while the guide wall which is to extend at an angle to the bottom wall of the dirt-collecting receptacle is produced separately and subsequently connected to the remainder of the dirt-collecting receptacle in an especially simple manner without any need for special tools or similar connecting means.

In order to achieve a simple and reliable connection of the guide wall which extends at an angle to the bottom wall and away from the brush in the assembled condition of the dirt-collecting receptacle with the housing, it can be made of synthetic plastic material and may have, at its marginal portion which is to be juxtaposed with the corresponding marginal portion of the bottom wall of the dirt-collecting receptacle, with a rib-shaped bulge and with a rib-shaped projection which engage a forwardly and upwardly open, groove-shaped recess of the marginal portion of the bottom wall. Furthermore, at least one pin-shaped projection may be formed on the rib-shaped bulge spaced from the marginal portion of the guide wall, which engages in a cutout of the bottom wall of the dirt-collecting receptacle. In this manner, the guide wall which extends at an angle to the bottom wall is easily assemblable with the remainder of the dirt-collecting receptacle in that the marginal portion thereof is simply juxtaposed with the corresponding marginal portion of the bottom wall of the dirt-collecting receptacle from above, and relative displacement of the wall in all other but the upward direction is prevented by the pin-shaped projection received in the cutout. After the engagement of the lateral projections in the recesses of the side walls of the dirt-collecting receptacle, a lifting of the guide wall which extends at an angle to the bottom wall of the dirt-collecting receptacle is also prevented.

The above-mentioned rib-shaped projection can extend over the entire length of the marginal portion of the guide wall, so that a dirt-tight connection is achieved between the bottom wall of the dirt-collecting receptacle and the separate guide wall which is connected to the remainder of the dirt-collecting receptacle so as to extend at an angle to the bottom wall thereof.

In sweeping devices in which the dirt-collecting receptacle is introduceable into the housing from above and in which the dirt-collecting receptacle includes bulges on its side walls having abutment shoulders by means of which the dirt-collecting receptacle rests on the upper border region of the frame-shaped portion of the housing, there can be provided, according to a further concept of the invention, a deflectable tongue extending downwardly from the abutment shoulder of the dirt-collecting receptacle and connected to the above-mentioned bulge, such at least one tongue which extends downwardly pressing against the inner side of the frame-shaped portion of the housing. The above-mentioned tongue can be provided with an approximately semi-spherical projection on its side which faces toward the frame-shaped portion of the housing. This semi-spherical projection on the deflectable tongue can then engaged behind the frame-shaped portion of the housing. In this manner, the dirt-collecting receptacle is provided with a particularly simply manufacturable arresting means, by means of which the dirt-collecting receptacle is reliably connected to the frame-shaped portion of the housing of the sweeping device. When the dirt-collecting receptacle is to be removed from the housing, this can be achieved in a very simple manner by pressing against the dirt-collecting receptacle from below so that the same is pushed upwardly, after deflecting the tongue, and can be taken out of the aperture bounded by the frame-shaped portion of the housing.

It is equally possible, as also proposed by the present invention, for use in sweeping devices in which the dirt-collecting receptacle is introducible into the housing from above and which dirt-collecting receptacle is provided with respective bulges on its side walls having respective abutment shoulders, which abutment shoulders rest against the upper border region of the frame-shaped portion of the housing, according to a further concept of the present invention, to provide the dirt-collecting receptacle with at least one resiliently yieldable tongue cooperating with the frame-shaped portion of the housing, the tongue having an arresting projection which connects the tongue to the respective side wall by snap-action. The arresting projection, or male portion, is received in a corresponding female portion of the respective side wall. In this manner, the need for slits or the like arrangements which separate the tongues from the respective side walls of the previously discussed embodiment are avoided in a very simple manner, which slits or similar arrangements render the production of the dirt-connecting receptacle more expensive and difficult. In this embodiment, the flexible tongues can be produced separately and, in a simple manner and without additional tools or similar arrangements, connected to the lateral or side walls of the dirt-collecting receptacle.

The flexible tongue can then have the above-mentioned male portion configurated as a pin which is received in a cutout of the lateral or side wall of the dirt-collecting receptacle which constitutues the female portion, the male portion having, at its free end, an arresting nose which engages with the inner surface of the respective side wall of the dirt-collecting receptacle when the tongue is assembled therewith. Therefore, in order to connect the tongue to the respective side wall, it is merely necessary to introduce the male portion with the arresting nose at the free end thereof through the cutout of the side wall of the dirt-collecting receptacle, until the arresting nose engages behind the inner surface of the respective side wall.

The flexible tongue is to be kept at a distance from the respective side wall of the dirt-collecting receptacle, and spacers are provided for keeping the flexible tongue at such a distance from the respective side wall. Thus, the flexible tongue can resiliently yield in direction toward the respective side wall of the dirt-collecting receptacle, so that the arresting projection provided on the tongue can be disengaged from the frame-shaped portion of the housing of the sweeping device.

The above-mentioned spacers can be constituted by a bulge provided at the lowest end of the tongue and abutting against the outer surface of the respective side wall of the dirt-collecting receptacle in the assembled condition, and an enlarged portion of the male portion which has dimensions exceeding those of the female portion, which also abuts against the outer surface of the dirt-collecting receptacle. In this manner, the flexible tongue is kept, in a very simple manner, at the required distance from the respective side wall of the dirt-collecting receptacle.

In order to be able to displace the flexible tongue into its releasing position, an upper free end of the flexible tongue extends upwardly beyond the frame-shaped portion of the housing of the sweeping device.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 12 is a fragmented sectional view taken on line XII—XII of FIG. 11;

FIG. 13 is a fragmentary view taken on line XIII—XIII of FIG. 11; and

FIG. 14 is a view corresponding to FIG. 13 but having different arresting means.

DETAILED DISCUSSION OF THE PREFERRED EMBODIMENTS

Figure 1:
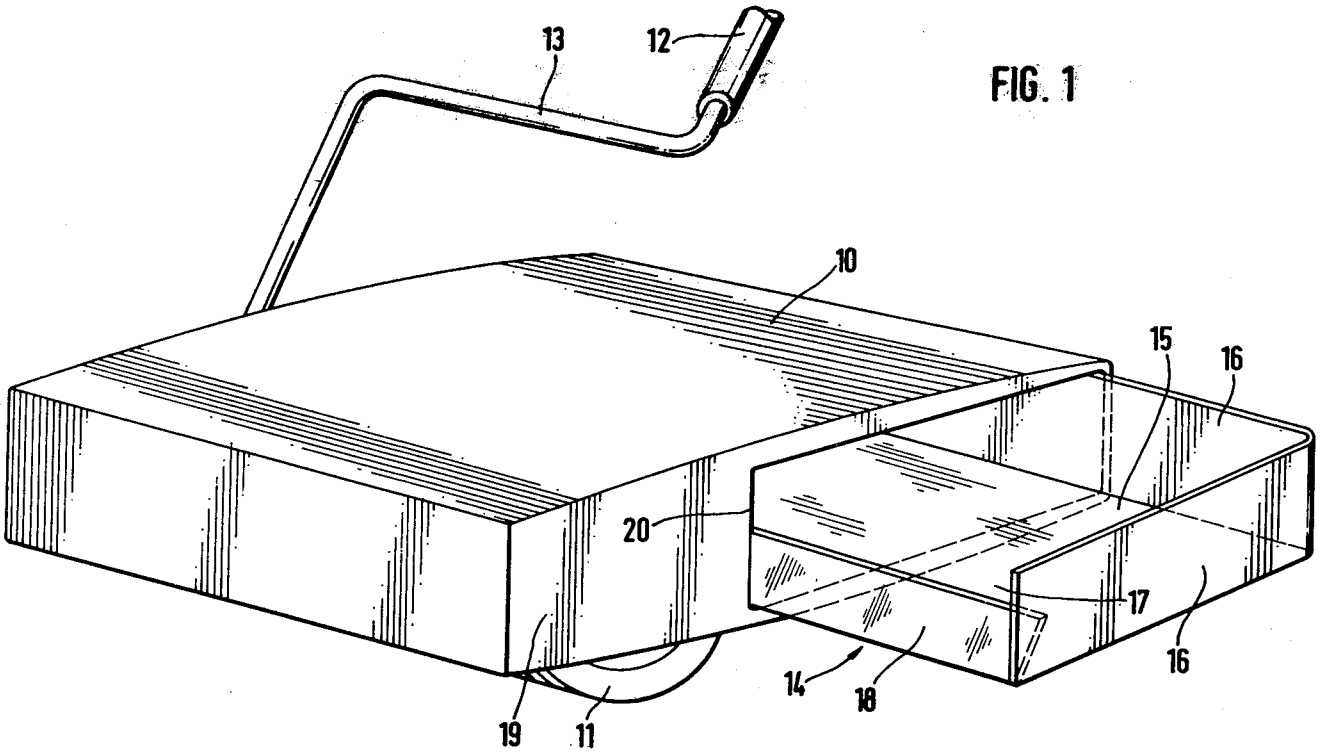
FIG. 1 is a perspective view of a sweeping device according to the present invention in which the dirt-collecting receptacle is introducible into the housing of the sweeping device from one lateral side thereof, parallel to a cylindrical brush axis.

Referring now to the drawing in detail, and first to FIG. 1 thereof, it may be seen therein that the sweeping device, such as a carpet sweeper, of the present invention includes a housing 10. A brush 11 is mounted in the housing 10 in a conventional manner which has not been illustrated, for rotation, and is driven into rotation by support wheels or rollers, also in a conventional, non-illustrated manner. For moving the carpet sweeper over the surface to be cleaned, there is provided an actuating rod 12 connected to the housing 10, by means of a bent bracket 13.

A dirt-collecting receptacle 14 is juxtaposed with the cylindrical brush 11 and extends along the same, around the path of travel of the dirt picked up by the cylindrical brush 11. The dirt-collecting receptacle 14 is constructed in a manner resembling a drawer, that is, it has a bottom wall 15, on three sides of which there are provided vertically upwardly extending walls 16, including side walls and a limiting wall spaced from the brush 11. At the side of the dirt-collecting receptacle 14 which faces the cylindrical brush 11 in the assembled position, there is provided an inlet opening 17. A guide wall 18 extends over the entire length of the cylindrical brush 11 and along the inlet opening 17, the guide wall 18 being connected to the bottom wall 15 and extending at an acute angle relative thereto, in direction upwardly and away from the cylindrical brush 11. As illustrated in FIG. 1, the dirt-collecting receptacle 14 is introducible into the housing 10 parallel to the cylindrical brush 11. For this purpose, the housing 10 is provided with an opening 20 in lateral side 19 thereof, through which the dirt-collecting receptacle 14 is introducible into the aperture provided in the interior of the housing 10. Non-illustrated conventional guides are provided for guiding the dirt-collecting receptacle 14 into and out of the housing 10, so that the dirt-collecting receptacle 14 is shiftable into and out of the housing 10 in a very simple manner. In order to arrest the dirt-collecting receptacle 14 in its fully inserted position, conventional, non-illustrated arresting means can be provided on the housing 10 and on the dirt-collecting receptacle 14.

When the carpet sweeping device of the present invention is used according to its intended use, the cylindrical brush 11 picks up dirt from the carpet or similar surface being swept and advances the same in direction toward and into the dirt-collecting receptacle 14. The dirt thus enters the interior of the dirt-collecting receptacle 14 through the inlet opening 17. The inwardly inclined guide wall 18 serves to guide the dirt on its way into the interior of the dirt-collecting receptacle 14.

When it is desired to empty the dirt-collecting receptacle of the dirt accumulated therein, the dirt-collecting receptacle 14 is taken out of the housing 10, and the contents thereof is discharged into a waste-receiving vessel or the like. Thereafter, the dirt-collecting receptacle 14 is again introduced into the housing 10 and thus the sweeping device is again rendered operative.

Figure 2:
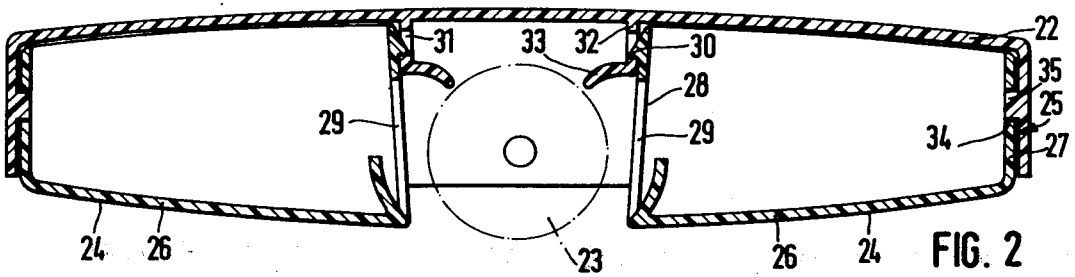
FIG. 2 is a longitudinal section through a sweeping device of the present invention in which the dirt-collecting receptacle is introducible into the housing from below.

In the embodiment illustrated in FIG. 2, the reference numeral 22 designates the housing, in which again a cylindrical brush 23 is mounted for rotation. In order to simplify the drawing, the wheels or rollers which drive the cylindrical brush 23 in rotation have been omitted. The cylindrical brush 23 is mounted in the central region of the housing 22, between the front and rear regions thereof, and one dirt-collecting receptacle 24 is arranged at both the front and rear regions of the housing 22, frontwardly and rearwardly of the cylindrical brush 23. Thus, when the carpet sweeping device is moved over the surface to be swept in the frontward direction, dirt picked up by the cylindrical brush 23 is deposited into one of the dirt-collecting receptacles 24, and dirt is deposited into the other dirt-collecting receptacle during the movement of the carpet sweeping device over such surface to be swept in the opposite, that is, rearward, direction. The housing 22 bounds downwardly open apertures 25 in which the dirt-collecting receptacles 24 are insertable from below as considered in the illustrated position of the housing 22.

Each dirt-collecting receptacle 24 has a bottom wall 26, and a plurality of walls 27 and 28 extends upwardly from the bottom wall 26 along the entire circumference of the latter. The bottom walls 26 of the dirt-collecting receptacles 24 simultaneously constitute the respective portions of the bottom of the carpet sweeping device.

The guide wall 28 of the dirt-collecting receptacle 24, which faces toward the cylindrical brush 23, bounds an inlet opening 29 which extends over the entire axial length of the cylindrical brush 23. The guide wall 28, which extends between the bottom wall 26 and the inlet opening 29, is inclined relative to the bottom wall 26 and inwardly into the interior of the dirt-collecting receptacle 24, thus presenting a guide surface for the dirt which is thrown into the dirt-collecting receptacle 24 by the action of the cylindrical brush 23.

A nose-shaped projection 30 is provided at the upper edge of the guide wall 28, which engages in a recess or cutout 31. The cutout 31 is provided on a partitioning wall 32 which is arranged at the inner side of the housing 22. The partitioning wall 32 simultaneously constitutes a guide surface, together with a wedge-shaped end 33, for the dirt which is being introduced into the interior of the dirt-collecting receptacle 24.

The limiting wall 27 which is spaced from the cylindrical brush 23 in the fully inserted position of the dirt-collecting receptacle is provided with a cutout 34, into which a projection 35 engages, the projection 35 being provided at the inner surface of the housing 22. As the result of engagement of the projection 35 in the cutout 34 and of the engagement of the nose-shaped projection 30 in the cutout 31, the dirt-collecting receptacle 34 is reliably held in the housing 22. The projections 30 and 35 can be disengaged from the cutouts 31 and 34, respectively as a result of elastic deformation of the dirt-collecting receptacle 24 and/or the housing 22, so that the dirt-collecting receptacle 24 can be removed from the housing 22 in a simple manner.

Figure 3:
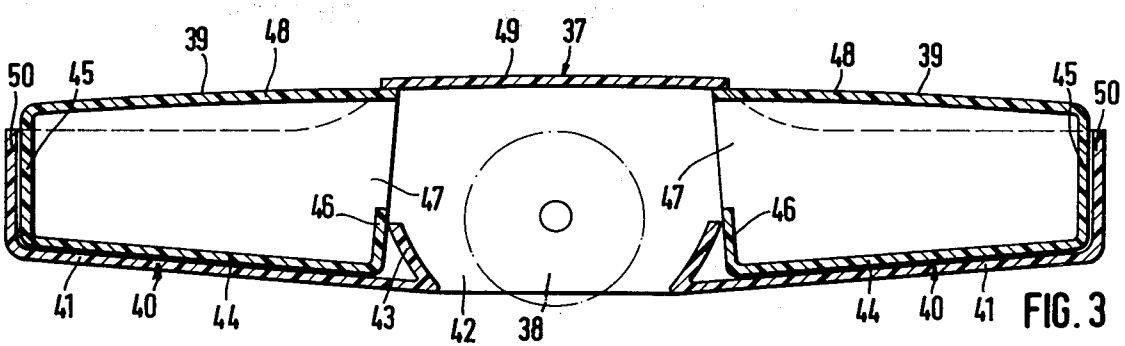
FIG. 3 is a view similar to FIG. 2 but of a sweeping device in which the dirt-collecting receptacle is introducible into the housing from above.

In the carpet sweeping device illustrated in FIG. 3, a housing 37 again has a cylindrical brush 38 in the central region thereof, the cylindrical brush 38 being mounted in the housing 37 for rotation. Here again, for the sake of simplicity, the wheels or rollers which drive the cylindrical brush 38 have been omitted.

The housing 37 is equipped with two dirt-collecting receptacles 39, of which one is arranged frontwardly of, and the other rearwardly of, the cylindrical brush 38, as considered in the direction of movement of the carpet sweeping device over the surface being swept. The housing 37 is provided with apertures 50 adapted to receive the dirt-collecting receptacles 39, the apertures 40 being open in the upward direction so that the dirt-collecting receptacles 39 are introducible into the apertures 40 of the housing 37 from above. Herein, the housing 37 includes a bottom 41 having a cutout 42 through which the cylindrical brush 38 extends from the interior toward the exterior of the housing 37. The bottom 41 is provided, at the marginal portions thereof which bound the cutout 42, and walls 43 which are inclined with respect to the bottom 41 and diverge from one another in the upward direction. These walls 43 present guide surfaces for guiding the dirt which is picked up and forwarded by the cylindrical brush 48 into the respective dirt-collecting receptacle 39.

Each of the dirt-collecting receptacles 39 has a substantially rectangular bottom wall 44, and a plurality of upwardly extending walls 45, 46 substantially normal to the bottom wall 44 and situated circumferentially of the latter. The guide wall 46 which is located adjacent to the cylindrical brush 38 partly bounds an inlet opening 47. However, the dirt-collecting receptacle 39 also has a top wall 48 which closes the interior of the dirt-collecting receptacle 39 in the upward direction, which top wall 48 is formed of one piece with the vertically upwardly extending lateral walls 45 at a distance from the bottom wall 54. This top wall 48 which closes the dirt-collecting receptacle 39 in the upward direction, simultaneously constitutes a portion of the top of the carpet sweeping device.

The dirt-collecting receptacle 39 has a marginal portion juxtaposed with the cylindrical brush 38 and which engages a housing wall 49 which constitutes a further portion of the top of the carpet sweeping device. The bottom wall 44 of the dirt-collecting receptacle 39 rests on the bottom 41 of the housing 37. The bottom 41 of the housing 37 is provided, at its marginal portion which is spaced from the cylindrical brush 38, with an upwardly extending support wall 50 which comes into abutment with the limiting wall 45 of the dirt-collecting receptacle 39. In this manner, the dirt-collecting receptacle 39 is reliably held in the housing 37. The dirt-collecting receptacle 39 can be taken out of the housing 37, or the aperture 40 thereof, by elastically deforming the dirt-collecting receptacle 39 and/or the housing 37.

Figure 4:
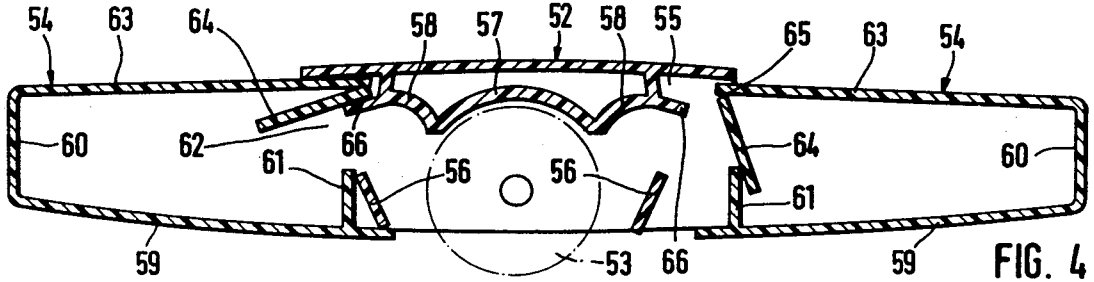
FIG. 4 is a view similar to FIG. 2 but of a sweeping device in which the dirt-collecting receptacle is introducible into the housing horizontally from the front and back of the housing, respectively.

In the embodiment illustrated in FIG. 4, the housing 52 is equipped with a cylindrical brush 53, which is mounted in the housing 52 for rotation. Here again, the wheels or rollers which serve to drive the cylindrical brush 53 in rotation have been omitted in order not to unduly encumber the drawing. Two dirt-collecting receptacles 54 are again associated with the cylindrical brush 53, one of the dirt-collecting receptacles 54 being located frontwardly of the cylindrical brush 53 and the other rearwardly of the cylindrical brush 53.

In this embodiment, the housing 52 basically constitutes only the center portion of the carpet sweeping device, and is provided with apertures 55 in which the two dirt-collecting receptacles 54 are introducible into the housing 52 horizontally of the latter in its operating position, from the front and from the rear, respectively. The guiding arrangements which are needed for insertion of the dirt-collecting receptacle 54 into, and its removal from, the housing 52 have also not been illustrated for the sake of simplicity.

In this currently preferred embodiment, the housing 52 is provided, at both sides of the cylindrical brush 53 and at the lower region of the housing 52, with inclinedly outwardly extending partitioning walls 56 which serve as guides for the dirt which is advanced by the cylindrical brush 53 into the respective dirt-collecting receptacles 54. A further guiding wall 57 is provided upwardly of the cylindrical brush 53, covering the cylindrical brush 53 from above, and having lateral regions 58 which extend all the way up to the dirt-collecting receptacles 54.

Each dirt-collecting receptacle 54 includes a bottom wall 59 which simultaneously forms the bottom of the carpet sweeping device. The bottom wall 59, which is generally rectangular, is provided, at its border region, with side walls 60, 61, the side walls 60 simultaneously constituting the sides of the carpet sweeping device. On the other hand, the guiding wall 61 of the dirt-collecting receptacle 54, which is located adjacent to the cylindrical brush 53, is provided with an inlet opening 62 which extends over the entire actual length of the cylindrical brush 53. Here again, a top wall 63 which closes the interior of the dirt-collecting receptacle 54 in the upward direction, is integral with the walls 60 of the dirt-collecting receptacle 54, such a top wall 63 simultaneously constituting a portion of the top of the carpet sweeping device. On the wall 63 which closes the interior of the dirt-collecting receptacle 54 in the upward direction, and particularly on the marginal portion thereof which is located at the cylindrical brush 53, there is mounted a flap-shaped closing wall 64, by means of a weakened flexible connecting portion 65. The weakened portion 65 is preferably integrally formed with the top wall 63 and with the flap-shaped closing wall 64 and hingedly connects the latter to the former. Such is the case particularly when the entire dirt-collecting receptacle 54 is made of synthetic plastic material. The flap-shaped closing wall 64 is so constructed that it abuts an abutment 66 provided on the respective lateral region 58 of the guide wall 57 during the last portion of the insertion displacement of the dirt-collecting receptacle 54 into the housing 52, the abutment of the abutment 66 against the closing wall 64 resulting in displacement of the latter into its open position. Thus, in the fully inserted operative position of the dirt-collecting receptacle 54, the inlet opening 62 is not obstructed by the closing wall 64. On the other hand, when the dirt-collecting receptacle 54 is pulled out of the housing 52, the flap-shaped closing wall 64 assumes the closed position which is illustrated at the right side of FIG. 4, due to its own gravity. Thus, the inlet opening 62 of the dirt-collecting receptacle 54 is automatically closed during the removal of the dirt-collecting receptacle 54 from the housing 52.

Figure 5:
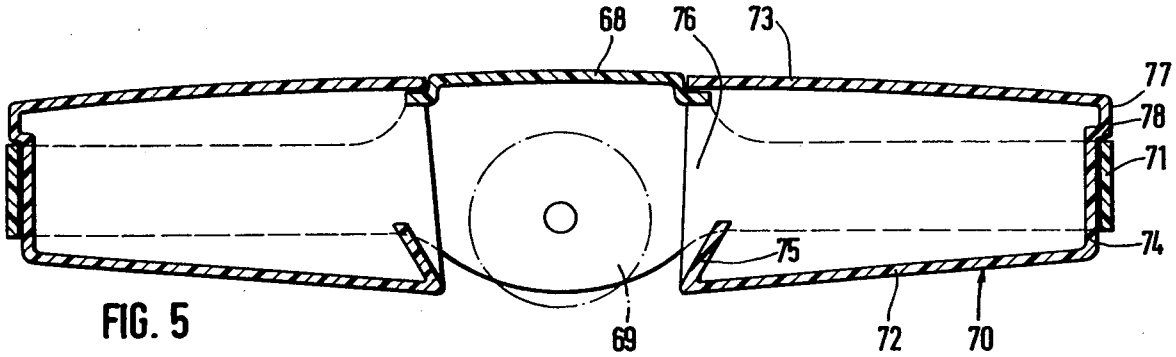
FIG. 5 is a view similar to FIG. 2 but of a sweeping device in which the dirt-collecting receptacle is introducible into the housing from above.

In the modification illustrated in FIG. 5, the housing 58 is again provided, in its central region, with a cylindrical brush 69, which is again rotatably mounted in the housing 58. Once more, the rollers or wheels on which the housing 68 is mounted for movement over the surface to be swept and from which the cylindrical brush 69 derives its rotary motion, have been omitted to simplify the drawing.

The housing 68 is equipped with two dirt-collecting receptacles 70, of which one is arranged frontwardly of the cylindrical brush 69 and the other behind the cylindrical brush 69. The dirt-collecting receptacles 70 are introducible into the housing 68 from below, and the housing 68 includes frame-shaped housing portions 71, so that the bottom walls 72 of the two dirt-collecting receptacles 70 basically form the bottom of the carpet sweeping device. On the other hand, the top walls 73 which close the respective dirt-collecting receptacle 70 in the upward direction, substantially constitute the top of the carpet sweeping device.

Each dirt-collecting receptacle 70 includes a substantially rectangular bottom wall 73, which is equipped, at its circumference, with upwardly extending walls 74 and 75. The guide wall 75 which is located in juxtaposition with the cylindrical brush 69 in the assembled position, partly bounds an inlet opening 76 which extends over the entire axial length of the cylindrical brush 69. The guide wall 75 which is situated between the bottom wall 72 and the dirt inlet opening 76 is bent into the interior of the dirt-collecting receptacle 70, so that it again presents a guide surface for the dirt which is thrown into the interior of the dirt-collecting receptacle 70 by the action of the cylindrical brush 69.

The top walls 73 which close the respective dirt-collecting receptacle 70 in the upward direction are formed on the walls 74, with spacing from the bottom wall 72. In this embodiment, the walls 74 are provided with a bulge 77 so that the dirt-collecting receptacle 70 is supported, by means of shoulders 78 formed on the bulges 77, on the upper border region of the frame-shaped portion 71 of the housing 68.

Figure 6:
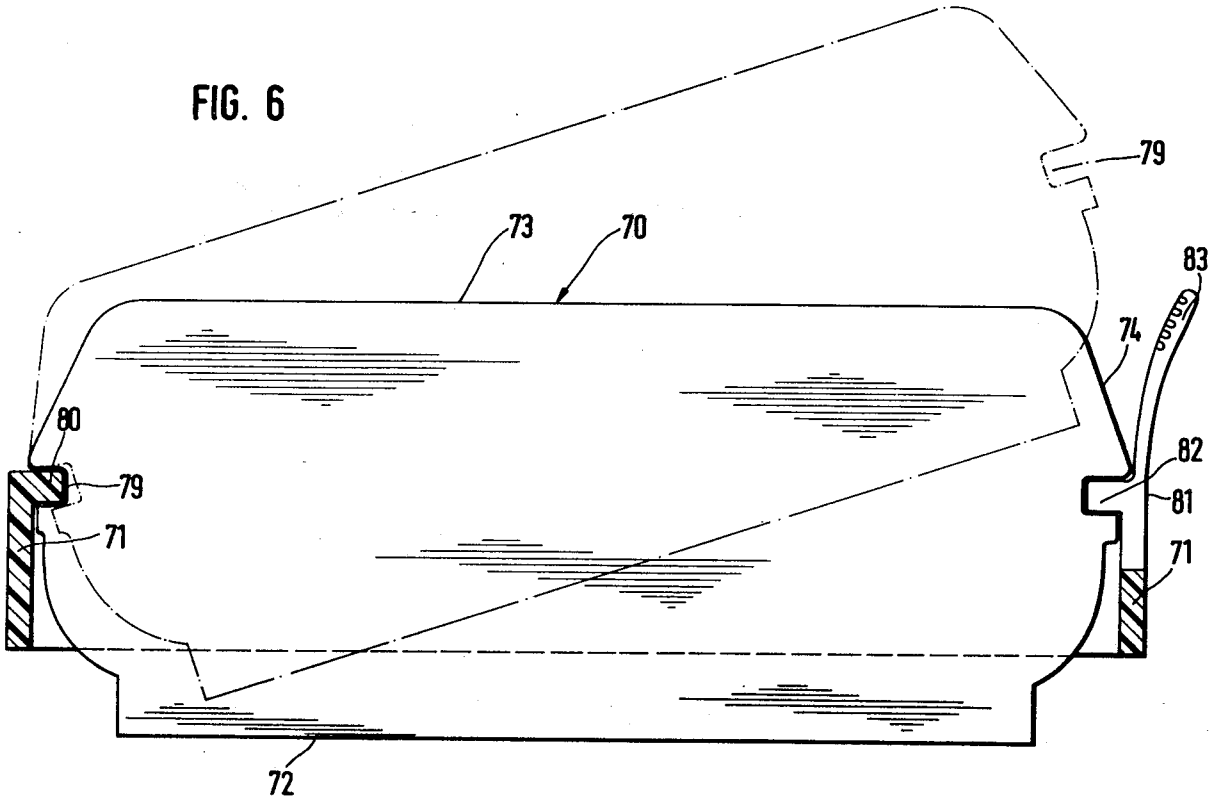
FIG. 6 is a sectional view taken on line VI—VI of FIG. 5, at an enlarged scale.

As is particularly ascertainable from FIG. 6, the dirt-collecting receptacle 70 which is introducible into the housing 68 from above is provided, on the side wall 74, with a horizontally extending groove 79 in each of the side walls 74. A rib-shaped projection 80 of the frame-shaped portion 71 of the housing 68 engages in one of the grooves 79, and a projection 82 formed on an elastically yieldable tongue 81 which, in turn, is deflectably connected to the frame-shaped portion 71 of the housing 68, engages in the groove 79. The elastically yieldable tongue 81 is provided with an extension 83 which serves as a handgrip for disengaging the projection 82 from the groove 79. When the tongue 81 is deflected away from the dirt-collecting receptacle 70, one side of the dirt-collecting receptacle 70 is to be removed from the frame-shaped portion 71 of the housing 68 first. The position assumed by the dirt-collecting receptacle 70 under these circumstances is illustrated in FIG. 6 in dash-dotted lines. Subsequently thereto, the dirt-collecting receptacle 70 can be completely withdrawn from the frame-shaped portion 71 of the housing 68.

As already mentioned before, the upper border region of the frame-shaped portion 71 of the housing 68 is provided with an inwardly oriented rib-shaped projection 80 on which the shoulders 78 of the dirt-collecting receptacle 70 rest when the dirt-collecting receptacle 70 is fully inserted into the aperture bounded by the frame-shaped portion 71 of the housing 68. This rib-shaped projection 80 can be used for engagement of resilient arresting portions 84, which are provided on the dirt-collecting receptacle 70. Such arresting portions 84 then engage the rib-shaped projection 80 from below.

Figure 8:
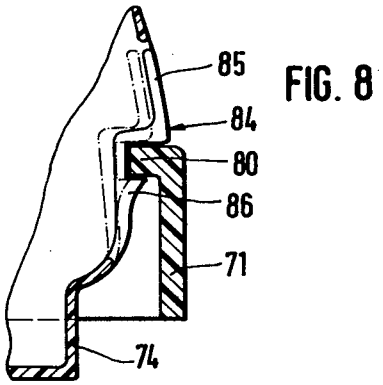
FIG. 8 is a fragmentary view similar to FIG. 6 but having still further arresting means.

In the modified embodiment of the present invention which is illustrated in FIG. 8, the resilient arresting portion 84 is obtained by providing a U-shaped slit in the side wall 74 of the dirt-collecting receptacle 70, to form a tongue 85 the free end of which is located upwardly of the frame-shaped portion 71 of the housing 68 in the fully inserted position. On the other hand, the lower end of the tongue 85, which is located downwardly of the inwardly oriented rib-shaped projection 80 of the frame-shaped portion 71 of the housing 58, merges with the side wall 74 of the dirt-collecting receptacle 70, and an outwardly inclined extending tongue-shaped projection 86 is provided thereat, which projection 86 engages the inwardly oriented rib-shaped projection 80 of the frame-shaped portion 71 of the housing 58, from below. When the tongue 85 is pressed inwardly, the tongue-shaped projection 86 can be disengaged, so that the dirt-collecting receptacle 70 can be taken out of the frame-shaped portion 71 of the housing 68. Such flexible arresting member 84, or a similar one, can be provided also on the other side wall 74 of the dirt-collecting receptacle 70.

Figure 7:
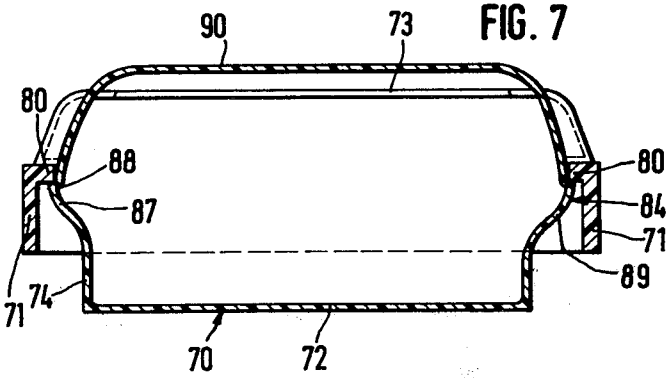
FIG. 7 is a view similar to FIG. 6 but having different arresting means.

In the embodiment illustrated in FIG. 7, the flexible arresting portions 84 are formed by shoulders 88 defined by bulges 87, provided with a tongue 81 separated from the remainder of the side walls 74 of the dirt-collecting receptacle 70 by a U-shaped slit, the tongue 89 extending in the upward direction of the dirt-collecting receptacle 70. One of such tongues 89 is provided at each of the side walls 74 of the dirt-collecting receptacle 70, these tongues 89 being connected with each other by means of a bracket 90 connected to the upwardly oriented free ends of the tongues 89. This bracket 90 extends upwardly out of the dirt-collecting receptacle 70, so that it can be engaged by using one hand. When the connecting bracket 90 is lifted upwardly, the flexible tongues 89 are displaced in the inward direction, so that the shoulders 88 become free from the inwardly oriented rib-shaped projection 80 of the frame-shaped portion 71 of the housing 68. In this manner, the dirt-collecting receptacle 70 can be removed from the frame-shaped portion 71 of the housing 68 by using only one hand, so that the other hand of the user of the sweeping device can be used for holding the sweeping device.

Figures 9, 10:
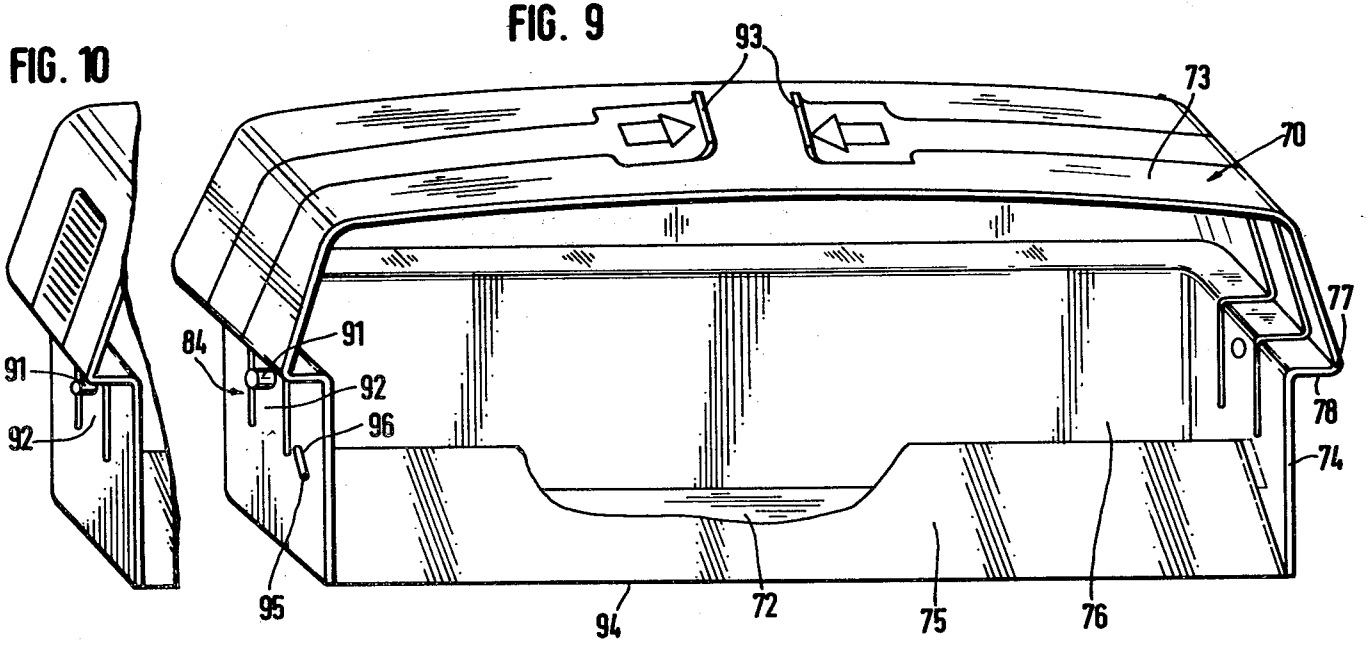
FIG. 9 is a perspective view of the dirt-collecting receptacle.
FIG. 10 is a fragmented view corresponding to FIG. 9 but in which the dirt-collecting receptacle has a different arresting means.

In the embodiment illustrated in FIG. 9, the flexible elastic portions 84 are constituted by inwardly extending pins 91 which are also provided on the flexible tongues 92 and which engage in non-illustrated corresponding detent recesses in the frame-shaped portion 71 of the housing 68.

In the embodiment illustrated in FIG. 10, the flexible tongues 92 are constructed correspondingly to the flexible tongues 85 of FIG. 8. In the embodiment illustrated in FIG. 9 again, the upwardly oriented free ends of the tongues 92 extend all the way to the top side of the dirt-collecting receptacle 70 and are provided at their free ends with gripping projections 93 which are arranged at such a distance from one another that both of them can be grasped by only one hand of the user and displaced relative to one another. Thus, when the gripping projections 93 are displaced toward one another, the flexible tongues 92 are pulled in the inward direction so that the dirt-collecting receptacle 70 can be taken out of the frame-shaped portion 71 of the housing 68.

In the exemplary embodiment of the present invention illustrated in FIG. 9 the inclinely extending guide wall 75 which extends between a bottom wall 72 and a dirt inlet opening 76 of the dirt-collecting receptacle 70 that is made of synthetic plastic material, is connected to the bottom wall 72 by a weakened hinging portion 94. The guide wall 75 has at its lateral edges at least two projections 95 which are received in corresponding recesses 96 of the side walls 74 of the dirt-collecting receptacle 70. When the guide wall 75 is connected to the bottom wall 72 in the above-mentioned manner, the manufacture of the dirt-collecting receptacle 70 is substantially simplified, in that the guide wall 75 can be formed together with the bottom wall 72, both in the same plane. After the manufacture of the dirt-collecting receptacle 70, the guide wall 75 is bent into the interior of the dirt-collecting receptacle. This bending is rendered possible by the provision of the flexible hinging portion 94. In the operating condition, the projections 95 engage in the recesses 96 of the side walls 74 of the dirt-collecting receptacle 70, so that the guide wall 75 is securely retained in such operating position.

Figure 11:
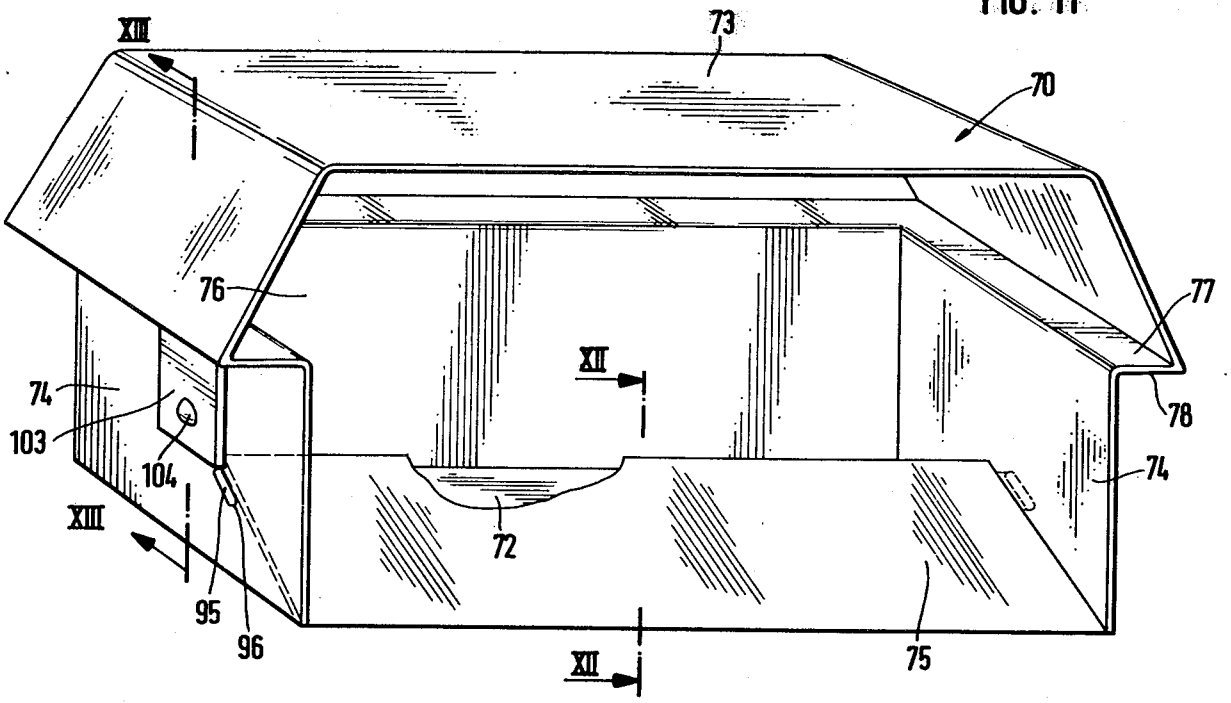
FIG. 11 is a perspective view of the dirt-collecting receptacle which is introducible into the housing from above.

The dirt-collecting receptacle 70 which is illustrated in FIGS. 11 to 13 has a substantially rectangular bottom 72 at the circumference of which there are provided substantially upwardly extending walls 74 and 75. The guide wall 75 of the dirt-collecting receptacle 70, which is to be juxtaposed with the above-discussed cylindrical brush, has a dirt inlet opening 76 which extends along the entire axial length of the cylindrical brush. The guide wall 75 which extends from the bottom wall 72 toward the dirt inlet opening 76 is inclined into the interior of the dirt-collecting receptacle 70, so that it constitutes a guide surface for the dirt which is being introduced into the interior of the dirt-collecting receptacle 70 through the inlet opening 76, during the rotation of the above-mentioned cylindrical brush.

The dirt-collecting receptacle 70 further has a top wall 73 which is formed of one piece with the walls 74 of the dirt-collecting receptacle and is spaced from the bottom wall 72. The lateral walls 74 are provided with a bulge 77, so that the dirt-collecting receptacle 70 can rest, by means of abutment shoulders 78 provided on the bulges 70, on the upper border region of the above-discussed frame-shaped portion of the housing.

In the dirt-collecting receptacle 70 illustrated in FIG. 11, the guide wall which is to be arranged underneath the dirt inlet opening 76 at the bottom 72 of the dirt-collecting receptacle 70 made of synthetic plastic material, and which is to extend at an angle to the bottom wall 72 into the interior of the dirt-collecting receptacle 70, is manufactured separately and has at its lower marginal portion respective projections 98, 99 which engage in recesses 100, 101 of the bottom wall 72 to form a positive connection therewith. The guide wall 75 which now extends at an angle into the interior of the dirt-collecting receptacle 70 is preferably also made of synthetic plastic material. It is provided, at its lower marginal portion, with a rib-shaped bulge 102 formed integrally with the guide wall 75. A rib-shaped projection 98 is provided at the marginal portion of the guide wall 75 and on the bulge 102, the rib-shaped projection 98 extending over the entire width of the dirt-collecting receptacle 70, and which engages in an upwardly and frontwardly open groove-shaped recess 100 of the bottom wall 72. At least one pin-shaped projection 99 is provided at the rear of the bulge 102, which pin-shaped projection 99 engages in a cutout 101 of the bottom wall 72. In this manner, the inclinedly extending guide wall 75 can be very easily and simply positioned on the bottom wall 72 of the dirt-collecting receptacle 70 from above, and thereafter is held, by the engagement of the projections 98 and 99 in the recesses 100 and 101, against movement in any other but upward direction. The inclinedly extending guide wall 75 is provided at its lateral edges with projections 95 which engage in corresponding recesses 96 in the side walls 74 of the dirt-collecting receptacle 70. In this manner, the inclinedly extending guide wall 75 is secured even against the lifting thereof in the upward direction. The inclinedly extending guide wall 75 can thus be positioned on and connected to the dirt-collecting receptacle 70 without any need for additional tools and the like.

As is more clearly perceivable from FIGS. 11 and 13, at least one downwardly directed deflectable tongue 103 is formed on the shoulder 78 provided on the bulge 77 of the dirt-collecting receptacle 70, the tongue 103 having an approximately semi-spherical projection 104 at that side thereof which is to face the frame-shaped portion of the housing. The semi-spherical projection 104 of the deflectable tongue 103 engages below the frame-shaped portion of the housing. In this manner, the dirt-collecting receptacle 70 which is introducible into the frame-shaped portion of the housing from above the same, can be arrested in its operating position, in that the deflectable tongue 103 and the semi-spherical projection 104 thereof cooperates with the frame-shaped portion of the housing. When it is desired to take the dirt-collecting receptacle 70 out of the frame-shaped portion of the housing, it is merely necessary to press from below on the dirt-collecting receptacle.

In the embodiment illustrated in FIG. 14, the dirt-collecting receptacle 70 is provided with at least one deflectable tongue 106 which cooperates with the frame-shaped portion of the housing and which has an arresting projection 107, the tongue 106 being arrestably held on the respective lateral wall 74 of the dirt-collecting receptacle 70. The deflectable tongue 106 has a projection 108 which constitutes a male connecting portion which is received in a female connecting portion 109 of the lateral side wall 74 of the dirt-collecting receptacle 70, constructed as a cutout. The male portion 108 is further provided, at its free end, with an arresting nose 110 which rests against the inner surface of the side wall 74. In this manner, the deflectable tongue 106 can be produced separately from the dirt-collecting receptacle 70 and connected thereto in an especially simple manner, particularly to the side walls 74 of the dirt-collecting receptacle 70. The deflectable tongue 106 is held at a distance from the side walls 74 of the dirt-collecting receptacle 70 and, for this purpose, it is provided with spacers. Such spacers include a bulge 111 provided at the lower end of the tongue 106, which abuts against the external surface of the side wall 74 of the dirt-collecting receptacle 70, and also an enlarged portion 112 of the projection or male portion 108 which has dimensions exceeding those of the female connecting portion 109. In this manner, the deflectable tongue can be deflected in the direction toward the side walls 74 of the dirt-collecting receptacle 70 in order to be able to remove the dirt-collecting receptacle 70 from the frame-shaped portion of the housing of the sweeping device. When this is attended to, the arresting projection 107 disengages the frame-shaped portion of the housing. In order to be able to displace the deflectable tongue 106 into the releasing position thereof, the upper end 113 of the tongue 106 extends upwardly beyond the frame-shaped portion of the housing, in the fully inserted position of the dirt-collecting receptacle 70.

It will be appreciated that the illustrated and discussed embodiments are only examples of the utilization of the basic concept of the present invention. Thus, many other modifications of the basic concept are also possible. So, for instance, the dirt-collecting receptacle 70 and/or the frame-shaped portion 71 of the housing 68 could be provided with projections having inclined surfaces which cooperate with edges of the housing or of the dirt-collecting receptacle. When this is done, the elasticity of the dirt-collecting receptacle and/or of the frame-shaped portion of the housing are utilized for enabling the projections provided with the inclined surfaces to engage one behind the other.

It will be understood that each of the elements described above, or two or more together, may also find a useful application in other types of constructions differing from the types described above.

While the invention has been illustrated and described as embodied in a carpet sweeping device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for sweeping surfaces, particularly carpets or the like, comprising a housing, at least one brush mounted on said housing in contact with the surface to be swept for rotation about an axis; means for rotating said brush about said axis so that dirt is picked up by said brush from a surface being swept and travels in at least one path; at least one dirt collecting receptacle of synthetic plastic material and having a substantially rectangular bottom wall, a limiting wall spaced from said brush, and a pair of side walls arranged laterally of said brush and extending therefrom along said bottom wall towards said limiting wall, the latter and said side walls extending substantially normal to and upwardly from said bottom wall being connected thereto and to one another, said side and bottom walls bounding an inlet opening of said dirt collecting receptacle situated in said path, a guide wall in said inlet opening, connected to and extending from said bottom wall at an angle to the latter away from said brush, and means for connecting said guide wall to said bottom and side walls, including a weakened flexible hinging portion connecting said guide wall to said bottom wall, and complementary detent projections and recesses on said side and guide walls, respectively, which engage each other with snap action when said guide wall extends at said angle.

2. A device as defined in claim 1, wherein said dirt-collecting receptacle further has a top wall connected to and extending between said side and limiting walls at a distance from said bottom wall.

3. A device for sweeping surfaces, particularly carpets or the like, comprising a housing; at least one brush mounted on said housing in contact with a surface to be swept for rotation about an axis; means for rotating said brush about said axis so that dirt is picked up by said brush from a surface being swept and travels in at least one path; at least one dirt collecting receptacle of synthetic plastic material and having a substantially rectangular bottom wall, a limiting wall spaced from said brush, and a pair of side walls arranged laterally of said brush and extending therefrom along said bottom wall towards said limiting wall, the latter and said side walls extending substantially normal to and upwardly from said bottom wall and being connected thereto and to one another, said side and bottom walls bounding an inlet opening of said dirt collecting receptacle situated in said path, a guide wall in said inlet opening connected to and extending from said bottom wall at an angle to the latter away from said brush; and means for detachably connecting said guide wall to said bottom and side walls, respectively, and comprising complementary recesses and projections at marginal zones of said bottom and guide walls which are juxtaposed with one another in the assembled condition of the dirt collecting receptacle and positively engaging each other, and additional complementary recesses and projections on lateral portions of said guide wall and on juxtaposed zones on said side walls which engage one another with snap action in said assembled condition.

4. A device as defined in claim 3, wherein said marginal zone of said guide wall has a rib-shaped formation thereon provided with said projection which is elongated in the longitudinal direction of said marginal zones; wherein said recess is an elongated groove extending along said marginal zone of said bottom wall; and wherein said connecting means further includes at least one cutout in said bottom wall spaced from said marginal zone thereof, and at least one pin-shaped projection formed on said rib-shaped formation spaced from said marginal zone of said guide wall and received in said cutout in said assembled position.

5. A device as defined in claim 3, wherein said complementary recesses and projections are elongated and extend from one of said side walls to the other side wall.

6. A device for sweeping surfaces particularly carpets, or the like, comprising a housing having a frame-shaped portion bounding an aperture and having a border region; at least one brush mounted on said housing in contact with a surface to be swept for rotation about an axis; means for rotating said brush about said axis so that dirt is picked up by said brush from a surface being swept and travels in at least one path; at least one dirt collecting receptacle of synthetic plastic material having a substantially rectangular bottom wall, a limiting wall spaced from said brush, and a pair of side walls arranged laterally of said brush and extending therefrom along said bottom wall towards said limiting wall, the latter and said side walls extending substantially normal to and upwardly from said bottom wall and being connected thereto and to one another, said side and bottom walls bounding an inlet opening of said dirt collecting receptacle situated in said path, said dirt collecting receptacle being received in said aperture and having bulges on said side walls which have abutment shoulders resting on said border region; and arresting means for arresting said dirt receiving receptacle upon assumption of a finally inserted position in said aperture, said arresting means including a tongue connected to said side wall for deflection on one end, said tongue having said abutment shoulder at the other free end thereof and an arresting projection on said one end; and means on said frame-shaped portion engaged by said arresting projection of said tongue in said fully inserted position.

7. A device as defined in claim 6, wherein said arresting portion is an inwardly oriented pin and wherein said means on said frame-shaped portion is an opening receiving said pin.

* * * * *

UNITED STATES PATENT AND TRADEMARK OFFICE

CERTIFICATE OF CORRECTION

PATENT NO. :4,263,689

DATED :April 28, 1981

INVENTOR(S) :Johannes Liebscher et al

It is certified that error appears in the above-identified patent and that said Letters Patent are hereby corrected as shown below:

At every occurrence of the inventors' names, change the last name of the first inventor to read -- Liebscher --.

Signed and Sealed this

*Eighteenth* Day of *August 1981*

[SEAL]

*Attest:*

GERALD J. MOSSINGHOFF

*Attesting Officer*

*Commissioner of Patents and Trademarks*